US011577870B1

(12) United States Patent
Raines et al.

(10) Patent No.: US 11,577,870 B1
(45) Date of Patent: Feb. 14, 2023

(54) ISOLATED FILM TENSION AND STEERING SYSTEM

(71) Applicant: Amazon Technologies, Inc., Seattle, WA (US)

(72) Inventors: Paul Roy Raines, Seattle, WA (US); Timothy Alan Talda, Renton, WA (US); Eric K. Wyman, Seattle, WA (US); Bruno Laffertt Zbinden, Lake Tapps, WA (US)

(73) Assignee: Amazon Technologies, Inc., Seattle, WA (US)

( * ) Notice: Subject to any disclaimer, the term of this patent is extended or adjusted under 35 U.S.C. 154(b) by 394 days.

(21) Appl. No.: 16/586,681

(22) Filed: Sep. 27, 2019

(51) Int. Cl.
*B65B 41/16* (2006.01)
*B65B 9/06* (2012.01)
*B65B 57/04* (2006.01)

(52) U.S. Cl.
CPC ..... *B65B 41/16* (2013.01); *B65B 9/06* (2013.01); *B65B 57/04* (2013.01)

(58) Field of Classification Search
CPC B65B 41/16; B65B 9/06; B65B 9/213; B65B 57/04; B65H 23/1888; B65H 23/1882; B65H 23/046; B65H 20/24; B65H 2220/01; B65H 2220/02; B65H 2511/112; B29C 65/7891; B31B 70/10
USPC ..... 53/51, 64
See application file for complete search history.

(56) References Cited

U.S. PATENT DOCUMENTS 4,708,301 A * 11/1987 Kataoka ..... B65H 20/16 242/413.5
4,754,593 A * 7/1988 Ishihara ..... B65B 9/213 53/64
4,775,086 A * 10/1988 Kataoka ..... B65H 23/1888 242/413.5
5,267,401 A * 12/1993 Freeman ..... B65H 23/1806 33/733
5,390,875 A * 2/1995 Gietman, Jr. ..... B65H 29/6609 242/528
10,472,107 B2 * 11/2019 Voss ..... B65B 1/02
2002/0059013 A1 * 5/2002 Rajala ..... B65H 20/34 700/122
2002/0107124 A1 * 8/2002 Colla ..... B31B 70/00 493/11
2003/0052148 A1 * 3/2003 Rajala ..... B65H 23/1888 226/44
2004/0132599 A1 * 7/2004 Colla ..... B31B 70/006 493/11

(Continued)

*Primary Examiner* — Dariush Seif
(74) *Attorney, Agent, or Firm* — Lee & Hayes, P.C.

(57) ABSTRACT

A film tensioning and steering system can be configured to extract a film from a film source. One or more film characteristics can require that the film tensioning and steering system be isolated from the film source so that a film tension can be maintained within the film tensioning and steering system. A first drive roller pair and a second drive roller pair can be configured to secure the film and enable a dampening roller to maintain the film tension between the first drive roller pair and the second drive roller pair. Additionally, the dampening roller can store an amount of the film as a film buffer. Accordingly, the film tensioning and steering system can maintain the film tension such that a steering system can align the film before the first drive roller pair provides the film at a proper alignment to a downstream system.

20 Claims, 9 Drawing Sheets

(56) References Cited

U.S. PATENT DOCUMENTS

| | | | | |
|---|---|---|---|---|
| 2006/0096065 | A1* | 5/2006 | Simon | B65H 23/188 19/163 |
| 2010/0108733 | A1* | 5/2010 | Fuwa | B65H 23/1888 226/1 |
| 2010/0202818 | A1* | 8/2010 | Fuchs | B65H 20/32 400/619 |
| 2013/0277487 | A1* | 10/2013 | Ohmura | B65H 26/025 242/419.8 |
| 2014/0357462 | A1* | 12/2014 | Voss | B65B 5/06 53/64 |
| 2014/0366487 | A1* | 12/2014 | Van Rijsewijk | B65C 3/065 53/55 |
| 2017/0096017 | A1* | 4/2017 | Fernando | B41J 11/0005 |
| 2017/0282601 | A1* | 10/2017 | Boland | B65H 20/02 |
| 2018/0037346 | A1* | 2/2018 | Fioravanti | B65B 9/2028 |
| 2019/0241288 | A1* | 8/2019 | Knueppel | B65B 9/04 |
| 2020/0215814 | A1* | 7/2020 | Miyoshi | B41F 13/025 |

* cited by examiner

ISOLATED FILM TENSION AND STEERING SYSTEM

BACKGROUND

With the increase of customers placing orders for the delivery of items (e.g., products), the number of packages delivered to customers continues to increase. This results in companies seeking to optimize operations related to the delivery of packages and to increase the efficiency of systems utilized in the packaging and delivery process. Currently, automated packaging systems used to package items can struggle to maintain the tension of film used to create the packages, suffer from poor film alignment, and experience inconsistent performance of the system due to one or more film characteristics. Additionally, the above issues cause further issues during package sealing and handling of the film source, ultimately requiring manual intervention for continued operation. This may result in a system that requires frequent maintenance, unnecessary intervention, and additional oversight to properly function.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical components or features.

DETAILED DESCRIPTION

Figure 1:
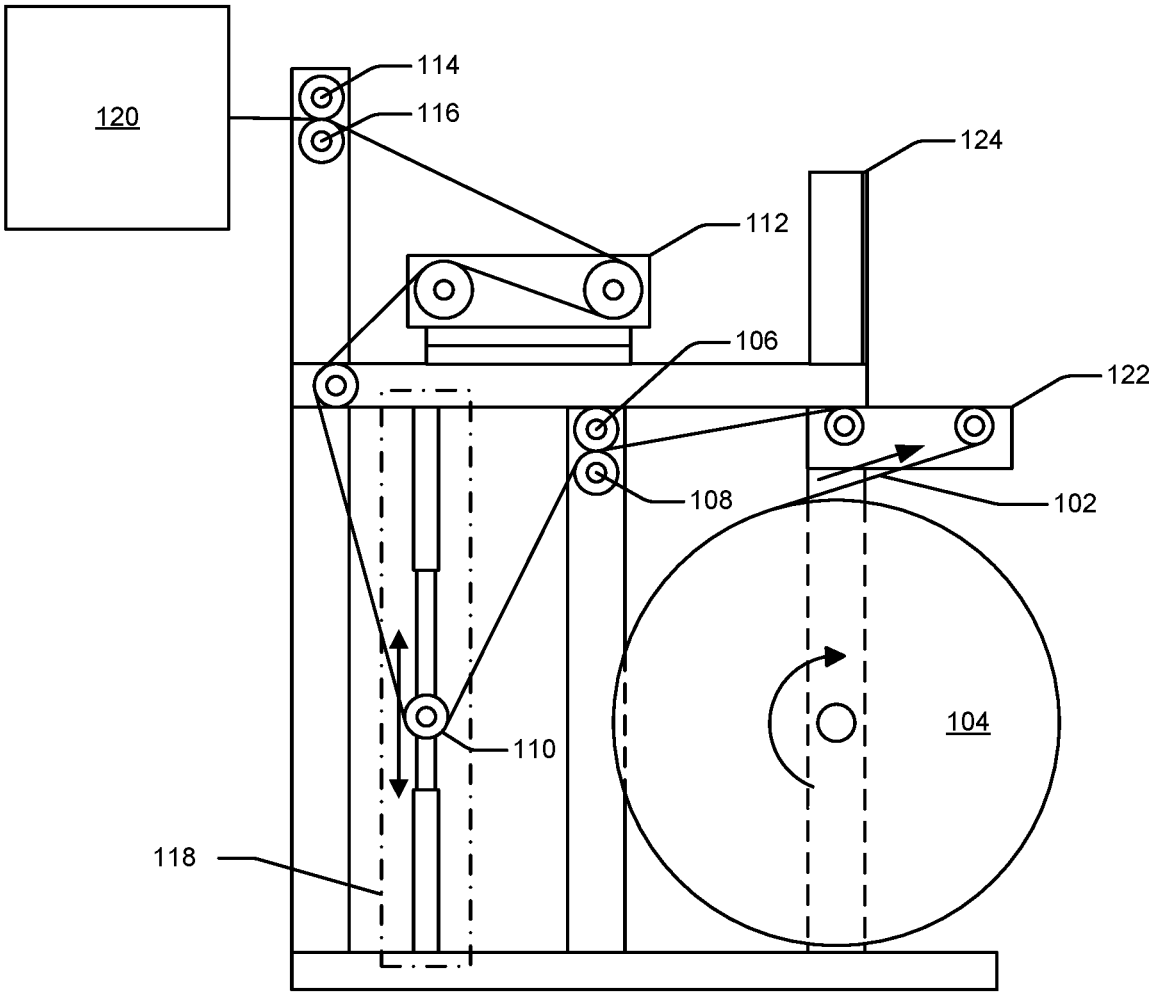
FIG. 1 illustrates an example system for extracting film from a film source and providing the film to downstream systems while maintaining a film tension so that a steering system can align the film according to requirements of the downstream system.

Described herein are systems and/or processes for maintaining film tension and alignment associated with a film utilized by a packaging facility. In some embodiments, a system can be implemented to operate between two pairs of drive rollers that isolate tensioning and steering systems from other systems within the packaging facility. By isolating the systems from other systems, an appropriate film tension can be maintained across one or more steering components. Additionally, the tensioning and steering operations further isolate downstream requirements and/or specifications associated with downstream systems from the upstream requirements and/or specifications associated with upstream systems. In at least one embodiment, downstream systems can include product packaging systems, package forming systems, package sealing systems, and/or other related systems. In at least one additional embodiment, upstream systems can include film forming systems, film splicing systems, film source systems, and/or other related systems.

Additionally, the described systems and processes maintain film tension and alignment based at least on one or more characteristics of the film and the film source. In particular, the film source is a loosely stored amount of film. Additionally, the extraction of film from the film source can be controlled by applying friction to a surface or edge of the film. Further, if the loosely stored amount of film is permitted to be compressed, the film can be damaged and rendered inappropriate for intended packaging applications. In some embodiments, the film is loosely wrapped around a mandrel that can be used to support the film source. Additionally, the film source can be controlled by application of friction to the outer layer of film of the film source and/or the sides of the film layers on the mandrel. Further, due to one or more characteristics of the film, braking cannot be applied to the mandrel as the loosely wrapped film can wrap tighter around the mandrel and potentially damage the film. In at least one embodiment, a compression threshold can indicate and/or define the amount of force or pressure that can be applied to the film without causing damage to the film. In some additional embodiments, the one or more characteristics of the film (e.g., film elasticity, film material properties, film composition, etc.) can cause the film to wander within the film source. Due to the film being loosely stored, the film can wander left and right, causing the film to telescope in one or more directions as outer and inner layers wander.

Without an isolated tensioning and steering system, the film source provides the film that is received by the packaging system and experiences spikes of force that extract the film. For instance, when a packaging system receives an item, the packaging system requests and receives the appropriate amount of film from the film source. In response to the request of the packaging system, the film is extracted from the film source at approximately the same rate that the packaging system receives it. Similarly, the film extraction starts and stops according to the requests. Additionally, the system generally aligns the film by manipulating the film source itself. Due to the film being steered by the film source, any adjustments made to the alignment of the film must traverse the length of film between the film source and the packaging system. This length of film can exceed the amount of film required for one or more packages. Further, the current systems control the film source by applying braking to the surface and sides of the stored film. As the film source is depleted, the braking becomes less effective due to the reduced surface that is available for friction to be applied to.

Additionally, where the film source provides the film to the packaging system, the standard system can fail to compensate for slack in the film. A slack film can be difficult for the system to steer and may result in poor alignment of the film. As a result, the poor alignment of film received by the packaging system can cause improper package formation, vertical seal failure, and other packaging errors that reduce system efficiency and require intervention by an operator and/or other systems. Additionally, replacement of the film source can cause system downtime while operators service the system. Further, the variable surface area of the film source can cause poor system performance. For instance, as the film source is emptied, the braking systems for the film source become less effective and the slack in the film become more difficult to compensate for. Similar to the replacement of the film source, the variable surface area can cause system downtime and require maintenance to adjust the braking systems of the film source.

Accordingly, the isolated tensioning and steering system described herein can assist in the packaging of items, the formation of seals during packaging operations, and prevent unnecessary maintenance and/or downtime of the film source. As noted above, the film within the film source experiences little to no film tension due to the one or more characteristics of the film and the manner in which the film is stored within the film source. The isolated tensioning and steering system can be implemented between the packaging system and the film source. The isolated system can include a first drive roller pair that provides film to the packaging system from a film buffer that stores an amount of film. Additionally, the isolated system can include a second drive roller pair that extracts film from a film source and provides the film to the film buffer for storage. Further, the first drive roller pair and the second drive roller pair can secure the film such that the film source does not experience intervals of high and low force being applied to the film. In particular, the isolated system can maintain a film tension between the first drive roller pair and the second drive roller pair that is required by a steering system. The steering system can be associated with the first drive roller pair and can be configured minimize the distance between a first location at which the film is aligned and a second location at which the film is provided to the packaging system. Additionally, the steering system can align the film to correct for the film wandering within the film source, compensate for variations in the film edges, and/or adjust for the edges curling out of a film guide. In at least one embodiment, one or more steering system requirements can include a minimum film tension and one or more thresholds that indicate a minimum and maximum adjustment that the steering system is capable of making to the film path.

Accordingly, the isolated tensioning and steering system can result in reduced system downtime as the film buffer can include sufficient film to form a plurality of packages. Additionally, the isolated system can produce more consistent alignment as the steering system can minimize the distance between the point of steering and the point that the packaging system receives the film. Further, the isolated system can maintain a film tension between the first drive roller pair and the second drive roller pair and store slack film within the tensioning film buffer. In at least one embodiment, the second drive roller pair can secure the film such that slack film within the film source does not impact the operation of the isolated system. Accordingly, the isolated system can reduce packaging and sealing errors associated with poor alignment of the film received by the packaging system.

In some embodiments, the one or more characteristics of the film can limit how the film can be manipulated and handled by the tensioning and steering system. In some embodiments, the one or more characteristics associated with the film can include one or more material properties associated with one or more materials that the film comprises, a configuration of the one or more materials, an elasticity of the film, a compression threshold of the film, and/or other physical properties of the film. Generally, the film is used by a packaging system to form protective packages for items. Accordingly, the film can comprise materials that are capable of protecting items from impacts, weather conditions, and light exposure. In at least one embodiment, the one or more materials can include one or more plastics. For example, the one or more materials can include high density polyethylene, low density polyethylene, and/or other polymers capable of being formed into the protective package for the item. Additionally, the materials of the film can be configured as to form a rolled web, a webbing, a bubble film, and/or other configurations that provide cushioning for the item within the protective package. Further, the configuration of the materials and the materials themselves impose elasticity and compression thresholds on the manipulation and handling of the film. For instance, the one or more materials can be associated with an elasticity threshold that indicates a limited amount of force that can be applied at film edges, along a film surface, and/or to the film surface before the material deteriorates. Additionally, the film can include one or more layers of materials that are attached and can be separated should the amount of force exceed the elasticity threshold. Further, the film can be configured to include pockets of air or another fluid within the film. The compression threshold can indicate an amount of force that, if applied to the surface of the film, may result in the film and the fluid pockets being damaged.

In some embodiments, one or more edges of the film include slight variations in at least one of the width of the film or the alignment of the film as it is extracted from the film source. Additionally, the wandering edges of the film can require the steering system to correct the film path to avoid packaging failures and to ensure that downstream systems can utilize the film. However, steering system operations can require the film tension to be maintained for optimal steering and correction of the film path. In at least one embodiment, the film tension can be determined based on one or more requirements associated with the steering system, one or more requirements associated with the downstream systems, and/or one or more characteristics associated with the film.

In some embodiments, a tensioning system is comprised of at least a dampening roller that maintains film tension between a first drive roller pair and a second drive roller pair. The dampening roller can maintain film tension by applying an amount of force to a section of the film as the film traverses the surface of the dampening roller. Additionally, the dampening roller can be a floating roller capable of movement along an axis. In some embodiments, the amount of force is determined to maintain at least the minimum film tension required for the steering system to effectively correct the film path. Additionally, the dampening roller can be configured to apply the amount of force to enable film steering. In some additional embodiments, the dampening roller can move along the axis in response to increases and decreases in film tension. Additionally, the dampening roller can be allowed to traverse a dampening axis due to springs, pneumatics, hydraulics, motors, actuators, and/or other appropriate means permitting motion of the dampening roller. Further, pneumatics can refer to pneumatic cylinders, gas coils, gas springs, and/or other pneumatic systems. Similarly, hydraulics can refer to hydraulic cylinders and/or other hydraulic systems. Springs can refer to compression spring systems and other dampening systems that rely on mechanical springs. Finally, fluid-based systems, such as pneumatics and hydraulics, can include a pressure regulator that modulates the internal pressure of the fluid-based systems to further control the dampening system and the dampening roller.

In some embodiments, the tensioning and steering systems can be implemented with a film buffer that stores an amount of film. The film buffer can store a sufficient amount of film for the downstream systems to produce one or more packages. Film can be extracted from the film buffer by the first drive roller pair at a first rate, to be provided to downstream systems. Additionally, film can be provided to the film buffer by the second drive roller pair at a second rate from a film source. In some additional embodiments, the first rate and the second rate are not equal and result in the film buffer depleting or filling. Additionally, the first rate and the second rate may be static or dynamic over a period of time. Further, the first rate can be modified based at least on the second rate and, similarly, the second rate can be modified based at least on the first rate.

In some additional embodiments, the film buffer can be maintained by the dampening roller. As noted above, the dampening roller can be configured to extend along the dampening axis as the second drive roller pair provides film from upstream systems and to fill the film buffer. Additionally, the dampening roller can retreat along the dampening axis as the first drive role extracts film from the film buffer to downstream systems to deplete the film buffer. In at least one embodiment, the extension and retreat of the dampening roller can be caused by the changes in film tension. In some additional embodiments, the variations in film tension can be caused by a difference between the first rate and the second rate. Additionally, at moments where the first rate is greater than the second rate, the dampening roller can be forced to retreat along the dampening axis to deplete the film buffer. Further, at moments where the first rate is less than the second rate, the dampening roller can extend along the dampening axis to fill the film buffer.

In some embodiments, a dampening sensor can be associated with the dampening roller. The dampening sensor can determine whether the dampening roller is extending, retreating, or remaining static along the dampening axis. Additionally, the dampening sensor can determine whether the film buffer is being filled or depleted by the first rate and the second rate. In at least one embodiment, the dampening sensor can determine dampening roller movements and film buffer status based at least on light sensors, such as lasers, IR beams, computer vision, or other forms of radiation sensors. In at least one additional embodiment, the dampening sensor can monitor the means by which the dampening roller traverses the dampening axis, including monitoring pneumatic systems, hydraulic systems, spring systems, and other such systems. For instance, the dampening sensor can monitor air pressure, hydraulic pressure, spring tension, or other variables.

In some embodiments, and as noted above, the first rate associated with the first drive roller pair and the second rate associated with the second drive roller pair can be static or dynamic over a period of time. Additionally, the first drive roller pair can extract film from the film buffer in response to a request received at a control system associated with the tensioning and steering operations. Similarly, the second drive roller pair can extract film from a film source in response to an indication or notification that the film buffer requires an amount of film. In at least one additional embodiment, the second rate is determined based at least in part on the first rate. In at least one additional embodiment, the second rate is determined based at least in part on measurements taken by the dampening sensor. In response to the dampening sensor detecting that the dampening roller is either extending or retreating, the second rate can be increased or decreased in response. For instance, the second rate can be decreased based at least on the dampening sensor detecting that the dampening roller is extending along the dampening axis. Additionally, the control system can determine that the film buffer is approaching a maximum capacity, based on the dampening sensor measurements, and cause the second rate to be decreased.

FIG. 1 illustrates an example system for isolating tensioning and steering systems from other associated systems. As shown in FIG. 1, a film 102 can be extracted from a film source 104 to be stored by the tensioning and steering systems and ultimately provided to packaging systems. In some embodiments, the film 102 generally moves in the direction indicated by the arrow associated with the film 102. Additionally, the film source 104 can rotate in the direction indicated by the curved arrow associated with the film source 104 while the film 102 is being extracted. Alternatively, the film source 104 can be configured to rotate opposite the indicated direction and/or in both directions. Further, the system can include a first drive roller 106 and a second drive roller 108 associated with a second drive roller pair, a dampening roller 110, a steering system 112, and a third drive roller 114 and a fourth drive roller 116 associated with a first drive roller pair.

In some embodiments, the second drive roller pair associated with first drive roller 106 and second drive roller 108 can be configured as a nip roller pair. For instance, first drive roller 106 and second drive roller 108 can be configured to have a predetermined distance separating the two drive rollers. Additionally, the predetermined distance can be determined based on one or more film characteristics, drive roller characteristics, drive motor characteristics, or other factors related to extracting the film 102 from the film source 104 via the second drive roller pair. Further, at least one of first drive roller 106 and second drive roller 108 can include a drive motor capable of causing the second drive roller pair to extract the film 102 from the film source 104. In at least one embodiment, the second drive roller pair is configured to isolate the film source 104 from the dampening roller 110. For example, the second drive roller pair can be configured to permit a determined amount of the film 102 to traverse the distance between first drive roller 106 and second drive roller 108.

In some embodiments, the dampening roller 110 can be configured to maintain a film tension to the film 102. For instance, an amount of force can be determined to maintain the film tension. Accordingly, the dampening roller 110 can be configured such that the amount of force is applied to the film 102 that traverses the dampening roller 110. The film tension can be determined based on at least one of one or more requirements associated with the steering system 112 and one or more film characteristics. Additionally, the dampening roller 110 can be configured to traverse an axis of dampening system 118. In at least one embodiment, the dampening roller 110 can be configured to move along a vertical axis as illustrated by the double-sided arrow associated with the dampening roller. In some additional embodiments, the dampening system 118 can include pneumatics, hydraulics, springs, motors, actuators, and other systems that permit the film tension to be maintained by dampening roller 110. Further, the dampening system 118 can include one or more sensors that collect data relating to movement of the dampening roller 110, the film tension, and other measurements associated with the dampening roller 110.

In some additional embodiments, the dampening roller 110 is associated with the dampening system 118. As noted above, dampening system 118 can include one or more hydraulic systems, pneumatic systems, springs, motors, actuators, and/or other systems that permit the film tension to be maintained by the dampening roller 110. The various implementations of dampening system 118 can include one or more of the above systems operating independent of additional systems or in tandem with additional systems. For instance, a first spring can be connected to the dampening roller 110 and an upper support while a second spring can be connected to the dampening roller 110 and a lower support such that differences in film tension are compensated for by movement of the dampening roller 110 caused by the first spring and the second spring. Further, one or more sensors can be associated with each system of the one or more systems to collect data regarding the movement of the dampening roller 110 and the status of the dampening system 118. The one or more sensors can include laser sensors, optical sensors, pressure sensors, position sensors associated with the dampening roller 110 and internal components of dampening system 118, and other sensors configured to monitor the position of the dampening roller and the state of the film 102. In at least one embodiment, a film buffer is associated with and maintained by the dampening roller 110 and the dampening system 118. Additionally, the film buffer can be maintained so that a predetermined amount of the film 102 is stored with the film buffer.

In some embodiments, the steering system 112 can be configured to maintain proper alignment of the film 102. Additionally, the steering system 112 can be configured to maintain proper alignment via rotation or linear adjustments of the steering system. For instance, the steering system 112 can rotate and/or alter a position associated with the steering system to apply a correction to the film path. As noted above, the steering system 112 can require sufficient film tension to enable the steering and correction of a film path. In some additional embodiments, the steering system can receive an indication that the film path deviation exceeds a tolerance and requires correction. The tolerance for film path deviation can be determined based at least on the downstream system requirements associated with a downstream system 120. Additionally, the indication that the film path deviation exceeds a tolerance can be received from the downstream system 120 or determined by a sensor associated with the steering system.

In some embodiments, and similar to the second drive roller pair, the first drive roller pair associated with a third drive roller 114 and a fourth drive roller 116 can be configured as an additional nip roller pair. Similar to the first drive roller 106 and the second drive roller 108, the third drive roller 114 and the fourth drive roller 116 can be configured to have a predetermined distance separating the two drive rollers. Additionally, the predetermined distance can be determined based on one or more film characteristics, drive roller characteristics, drive motor characteristics, or other factors that impact the first drive roller pair's ability to extract the film 102 from the film buffer and provide the film 102 to a downstream system 120. Further, at least one of first drive roller 106 and second drive roller 108 can include a drive motor capable of causing the second drive roller pair to extract the film 102 from the film source 104. In at least one embodiment, the second drive roller pair is configured to isolate the film source 104 from the dampening roller 110. For example, the second drive roller pair can be configured to permit the determined amount of the film 102 traverse the distance between first drive roller 106 and second drive roller 108.

In at least one embodiment, the drive roller characteristics can include a drive roller material, a drive roller shape, and a drive roller texture. The drive roller material can include a hardness of the material that indicates whether the film 102 can deform the surface of the roller. The drive roller shape can include a pattern that is impressed into the film surface or protrudes from the film surface. For example, the drive roller can include ridges that protrude from the surface of the drive roller to apply force to a smaller portion of the film 102 or to avoid fluid pockets that comprise the film 102. The drive roller texture can include a roughness of the drive roller that influences the amount of force required to secure the film 102.

In at least one additional embodiment, the drive motor characteristics can include one or more thresholds associated with the motor. For instance, the one or more thresholds can indicate a maximum torque, a minimum torque, a maximum speed, and a minimum speed that the motor is capable of applying and/or operating at.

In at least one further embodiment, the predetermined distance can be determined based at least on the one or more film characteristics, drive roller characteristics and drive motor characteristics. For instance, the drive roller characteristics can include a pattern that applies force to the film 102 between fluid pockets of the film 102. Accordingly, the predetermined distance can be determined such that, as the film 102 passes between the third drive roller 114 and the fourth drive roller 116, the force applied to the film 102 exceeds the amount of force that would damage the fluid pockets but is below the amount of force that would damage the film material. Similarly, the predetermined distance can be determined such that the amount of torque required to rotate the third drive roller 114 and the fourth drive roller 116 does not exceed the maximum torque of the motor.

In some embodiments, the system can be associated with the downstream system 120. The downstream system can be one or more of a product packaging system, a package forming system, a package sealing system, and/or other related systems. The product packaging system can comprise components that receive an item to be packaged, receive an amount of the film 102, and envelope the item within the film 102 to form a package to protect the item during deliver. Additionally, the package forming system can comprise components that receive the amount of the film 102 and manipulates it to form a package for the item. Further, the package sealing system can apply an adhesive, an amount of heat, and/or some other means of creating a seal to form or close the package. In at least one embodiment, the other related systems can include monitoring systems, error detection systems, and faulty package removal systems.

In some embodiments, the system further includes a splicing system 122 for combining a plurality of films from a plurality of film sources. For instance, the splicing system 122 can permit a trailing edge associated with the film 102 and the film source 104 to be adhered to a leading edge associated with a new film 102 and a new film source 104. In at least one embodiment, the splicing system can secure the trailing edge of film 102 and adhere the leading edge of the new film via application of a heat source that causes the trailing edge and leading edge to fuse into a single film. However, while heat is used as an example of adhering the trailing edge to the leading edge, the splicing system 122 can use other appropriate adhering techniques such as adhesives, other chemical bonds, and/or physical connectors.

In some embodiments, the system further includes a control system 124 that is configured to cause the above components and systems to respond the received indications from the downstream system 120, extract the film 102 from the film source 104, and maintain the film buffer via the dampening roller 110 and/or the dampening system 118. In some embodiments, the control system 124 can include a user interface that an operator of the machine can interact with to view alerts regarding the isolated tensioning and steering system and input commands when necessary. In at least one embodiment, the control system 124 can present a low film source alert that informs the operator the film source 104 needs to be or should be replaced. In at least one additional embodiment, the operator can input a command, via the user interface, to the control system 124 that causes the second drive roller pair to suspend operation so that the film source 104 can be replaced. Accordingly, an operator can utilize the control system 124 to observe the operations of the isolated tensioning and steering system, input commands, view alerts, and generally interact with the isolated system.

In some embodiments, the example system illustrated by FIG. 1 can include additional components beyond the labeled components. In some additional embodiments, one or more support rollers can be included by the example system. For instance, one or more support rollers can be incorporated by film source 104 for support and/or braking. Additionally, one or more support rollers can be utilized by the film buffer to increase the amount of film stored within the film buffer. Further, one or more support rollers can be included by the example system to reduce the amount of unsupported film, to assist in maintaining the film tension, or to provide a preferred path for the film 102.

Additionally, the spatial relationship of labeled and unlabeled components of FIG. 1 is not to be interpreted as limiting the example system. The specific location of the labeled and unlabeled components can be adjusted in various implementations of the system and the following methods. The example system illustrated comprises the above described systems and components, although they may be implemented in alternative combinations as system demands change.

Accordingly, FIG. 1 illustrates an example system comprising a film, a first drive roller pair, a second drive roller pair, a dampening roller, a sensor, and a control apparatus. The film can comprise a plurality of air pockets, one or more layers, and at least a pair of approximately parallel edges. In at least one embodiment, the compression threshold is associated with a maximum pressure that can be applied to the film without the film becoming damaged. The first drive roller pair can be configured to provide the film at a first rate to one or more downstream systems. The second drive roller pair can similarly be configured to extract the film at a second rate from a film source. The dampening roller can be configured to maintain a film buffer and a film tension between the first drive roller pair and the second drive roller pair. In at least one additional embodiment, the dampening roller maintains the film tension due to the first drive roller pair and the second drive roller pair isolating the film from the downstream and upstream systems. Additionally, the sensor can be associated with the dampening roller and determine how much film is currently stored by the film buffer.

In some additional embodiments, the example system can include the control apparatus. For instance, the control apparatus can receive an indication that the first amount of the film is to be provided by the first drive roller pair. Based at least on the indication, the control apparatus can cause the first drive roller pair to provide the first amount of the film, cause the second drive roller pair to provide the film to the film buffer from the film source, and determine the one or more rates at which the first drive roller pair and the second drive roller pair operate.

Figure 2:
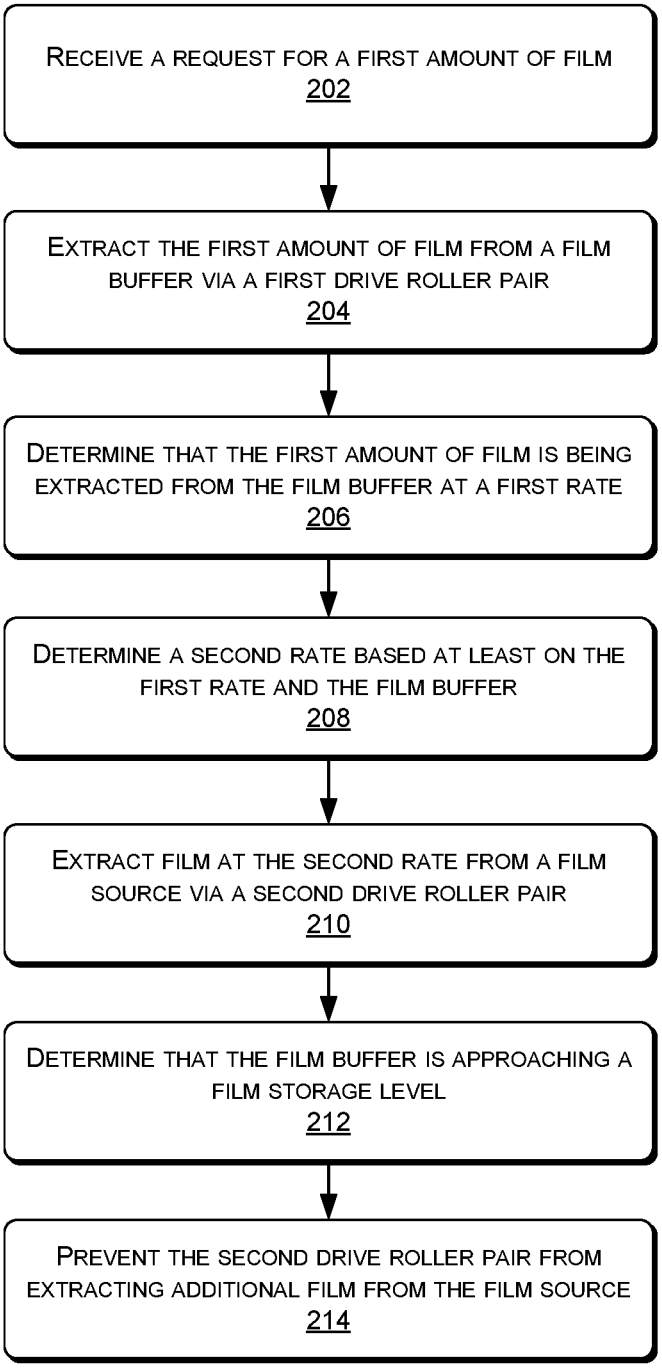
FIG. 2 illustrates an example method for providing an amount of film from isolated tensioning and steering systems that maintain the film tension and align the film for the downstream systems.

FIG. 2 illustrates an example method for providing an amount of film 102 from an isolated tensioning and steering system. In some embodiments, a control system associated with the tensioning and steering system illustrated by FIG. 1 can implement the following method steps to provide the amount of the film 102 from the isolated tensioning and steering system to a downstream packaging system.

Additionally, the control system can further cause the tensioning and steering system to extract additional film from a film source according to this method. As noted above, the tensioning and steering system isolates the film 102 between a first drive roller pair and a second drive roller pair. In at least one embodiment, isolation of the film 102 can include securing the film 102 by the first drive roller pair and the second drive roller pair such that the film 102 maintains a film tension.

At block 202, a system can receive a request for a first amount of the film 102. In some embodiments, the first amount of the film 102 is requested by a packaging system that is supplied by the system. Additionally, the film 102 requested by the packaging system can be sufficient to form one or more packages. Further, the request can comprise one or more orders for the first amount of the film 102, a requested rate at which the system provides the film 102, and other information that can cause the system to provide the first amount of the film 102.

In some additional embodiments, the packaging system provides a discrete request for the first amount of the film 102 for each event requiring the first amount of the film 102. Additionally, the request can indicate a plurality of individual times, a frequency, or other timing information that causes the system to repeatedly provide the first amount of the film 102 to the packaging system. Further, the request can indicate a second amount of the film 102 to be provided at a second time after the first amount of the film 102 is provided. Accordingly, the request can cause the system to immediately provide an amount of the film 102 to the packaging system and/or schedule the amount of the film 102 to be provided after certain conditions are met. For instance, the amount of the film 102 can be scheduled to be provided after an indication is received that the packaging system has deposited a previous package for delivery and/or that a previous amount of the film 102 has be consumed by the packaging system.

At block 204, the system can, in response to the request, extract the first amount of the film 102 from a film buffer via a first drive roller pair. In some embodiments, the first drive roller pair is comprised of third drive roller 114 and fourth drive roller 116. Additionally, the film buffer can include dampening roll 110 and dampening system 118. Further, the first drive roller pair can extract the first amount of the film 102 from the film buffer via one or more motors associated with third drive roller 114 and/or fourth drive roller 116. In at least one embodiment, the film buffer can include at least enough film to form a single package that encapsulates an item/product. In at least one additional embodiment the film buffer can include sufficient film to form a plurality of packages without needing to be refilled.

In some embodiments, the first drive roller pair is configured as a first nip roller comprised of third drive roller 114 and fourth drive roller 116 spaced at a predetermined distance. Additionally, the predetermined distance can be determined such that the film 102 is secured between third drive roller 114 and fourth drive roller 116. By securing the film 102, the first drive roller pair can isolate the film 102 within the tensioning and steering system from the film 102 being provided to the downstream systems. Further, the first drive roller pair can prevent changes in one or more film characteristics associated with the downstream systems from impacting the tensioning and steering system.

At block 206, the system can determine that the first amount of the film 102 is being extracted from the film buffer at a first rate. The system can determine that the first amount of the film 102 is being extract from the film buffer at a first rate based at least on a sensor associated with dampening roller 110 and/or dampening system 118. The sensor can monitor dampening roller 110 and/or dampening system 118 during operation of the system. Additionally, this enables the sensor to also monitor the film buffer and the amount of the film 102 stored by the film buffer. In some embodiments, the sensor can monitor the dampening roller 110 directly to determine a first position and a second position associated with the dampening roller 110 on an axis. By determining the difference between the first position and the second position, the system can identify a rate of change associated with the stored amount of the film 102 within the film buffer. In some additional embodiments, the sensor can monitor one or more components of dampening system 118 to determine the first position and the second position on the axis. Similarly, the system can identify the rate of change associated with the stored amount of the film 102 within the film buffer. In at least some further embodiments, the sensor can be a laser sensor, a pressure gauge, an electronic sensor, or any other sensor capable of monitoring the various systems that may be implemented within the dampening system 118.

At block 208, the system can determine a second rate based at least on the first rate and the film buffer. For instance, the system can determine a current amount of the film 102 stored by the film buffer. Additionally, and as noted above, the system can determine the rate of change associated with the film buffer. In some embodiments, the first rate can be determined to be the requested rate associated with the request for the first amount of the film 102. In some additional embodiments, the first rate can be determined to be the rate at which the first drive roller pair is providing the first amount of the film 102 to the packaging system. In some further embodiments, the first rate can be determined to be the difference between either the requested rate or the rate the first drive roller pair is providing the film 102 to the packaging system and the rate that the second drive roller pair is providing the film 102 to the film buffer. Accordingly, the system can determine a second rate based at least on the first rate and the current amount of the film 102.

In some additional embodiments, the film buffer can have a maximum threshold associated with the film 102 stored by the film buffer. In some embodiments, the maximum threshold can be respectively below the absolute maximum amount of the film 102 that the film buffer can store. Additionally, the maximum threshold can indicate the maximum amount of the film 102 that can be stored by the film buffer. Accordingly, the system can determine the second rate based at least in part on whether the current amount of the film 102 stored by the film buffer is equal to or is greater than the maximum threshold. For instance, should the current amount of the film 102 stored by the film buffer satisfy the maximum threshold, the second rate can be modified to have a lower value or set to zero.

In some additional embodiments, the film buffer can have a minimum threshold associated with the film 102 stored by the film buffer. In some embodiments, the minimum threshold can be above the absolute minimum amount of the film 102 that the film buffer can store. Additionally, the minimum threshold can indicate the minimum amount of the film 102 that can be stored by the film buffer. Accordingly, the system can determine the second rate based at least in part on whether the current amount of the film 102 stored by the film buffer satisfies the minimum threshold. For instance, should the current amount of the film 102 stored by the film buffer satisfy the minimum threshold, the second rate can be modified to have an increased value or set to a maximum speed associated with a drive roller motor.

At block 210, the system can extract the film 102 at the second rate from a film source 104 via the second drive roller pair. Similar to the first drive roller pair, the second drive roller pair can include first drive roller 106 and second drive roller 108. In some embodiments, the second drive roller pair can be configured as a second nip roller such that first drive roller 106 and second drive roller 108 are separated by a predetermined space. Additionally, the predetermined distance can be determined such that the film 102 is secured between first drive roller 106 and second drive roller 108. By securing the film, the first drive roller pair can isolate the film within the tensioning and steering system from the film being extract from the film source 104. Further, the second drive roller pair can prevent changes in one or more film characteristics associated with the film source 104 from impacting the tensioning and steering system.

At block 212, the system can determine that the film buffer is approaching a film storage level. Similar to block 206, the system can determine that the film buffer is approaching the film storage level based at least on the sensor associated with the dampening roll. In some embodiments, the film storage level can be the maximum threshold, the minimum threshold, the maximum amount of the film 102 that the film buffer can store, and/or the minimum amount of the film 102 that the film buffer can store. In particular, the system can determine that a stored amount of the film 102 in the film buffer is less than or equal to a threshold amount, as discussed above, that indicates that the film buffer requires additional film to be provided from the film source 104. Additionally, the system can determine that the stored amount of the film 102 in the film buffer is greater than or equal to the threshold amount, as discussed above, that indicates that the film buffer is nearly full.

At block 214, the system can prevent the second drive roller pair from extracting additional film from the film source 104. In some embodiments, the system can cause the second drive roller pair from extracting the film 102 from the film source 104 based at least on the request received by the system being complete. In some additional embodiments, the system can determine that the film buffer is approaching one of the thresholds discussed above or one of the amounts of the film 102 discussed above. For instance, should the amount of the film 102 stored in the film buffer approach the maximum threshold or the maximum amount of the film 102, the system can prevent the second drive roller pair from continuing to extract the film 102 from the film buffer.

Figure 3:
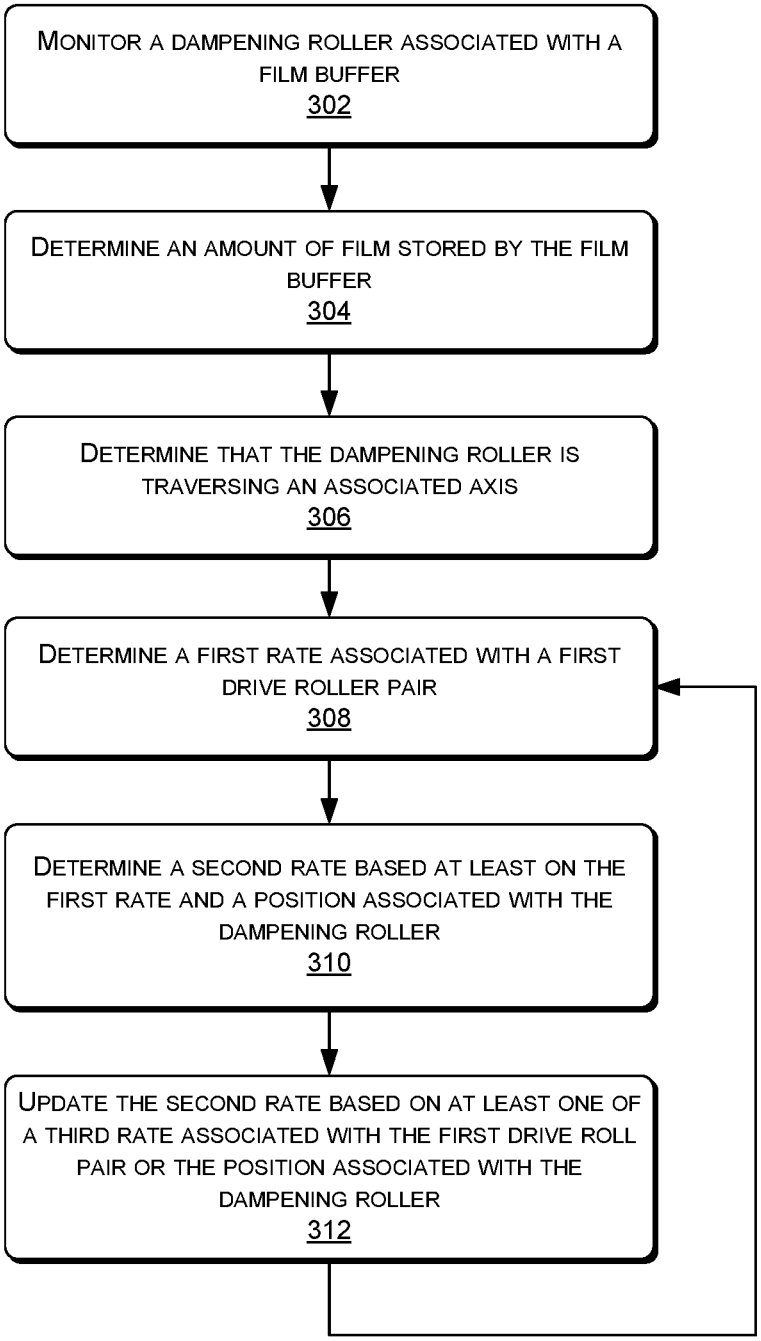
FIG. 3 illustrates an example method for maintaining film tension in an isolated tensioning and steering system through a film buffer comprising at least a dampening roller.

FIG. 3 illustrates an example method for maintaining film tension in an isolated tensioning and steering system. In some embodiments, a control system associated with the tensioning and steering system illustrated by FIG. 1 can implement the following method steps to monitor a dampening roll, an amount of film stored by a film buffer, and maintain a film tension between a first drive roller pair and a second drive roller pair. Additionally, the example method illustrated by FIG. 2 can include some or all steps illustrated by FIG. 3 and/or can occur concurrently with the example method illustrated by FIG. 3. Accordingly, the example method can isolate a tensioning and steering system and control a film between the first drive roller pair and the second drive roller pair. In at least one embodiment, isolation of the film can include securing the film by the first drive roller pair and the second drive roller pair such that the film maintains a film tension.

At block 302, a system can monitor a dampening roller associated with a film buffer. In some embodiments, the dampening roller can be the dampening roller 110. Additionally, the film buffer can include the dampening roller, the dampening system 118, and other components that cause the film buffer to store an amount of the film 102. In some additional embodiments, the film buffer can further include one or more support rollers, a sensor, and one or more supports associated with the system. In at least one additional embodiment, the film buffer can include a plurality of dampening systems. In some further embodiments, and as discussed above, a sensor can monitor the dampening roller and/or the dampening system.

At block 304 and based at least on the sensor that can monitor the film buffer, the system can determine the amount of the film 102 stored by a film buffer. In some embodiments the system can determine the amount of the film 102 stored by a film buffer based at least on locating the dampening roller in relation to the sensor or the dampening system.

At block 306, the system can determine that the dampening roller is traversing an associated axis. In some embodiments, the dampening roller can traverse the associated axis based at least on a difference between a first rate associated with a first drive roller pair and a second rate associated with a second drive roller pair. Based at least on the first drive roller pair securing the film 102 and the second drive roller pair also securing the film 102, the dampening roller and the dampening system function to absorb the difference between the first rate and the second rate. Additionally, the film buffer is maintained so that the film tension is not altered or is minimally altered when a difference exists between the first rate and the second rate. As a component of the film buffer, the dampening roller traverses the associated axis to absorb excess film provided by the second drive roller pair or to compensate for excess film extracted by the first drive roller pair. Accordingly, the film buffer and the dampening roller can prevent film damage by maintaining the film tension throughout operation of the first drive roller pair and the second drive roller pair.

In some additional embodiments, the system can determine that the dampening roller is traversing an associated axis based at least on a first position associated with the dampening roller and a second position associated with the dampening roller. For instance, the sensor can operate in a manner similar to that described at block 206. Additionally, the system can compare the first position and the second position to determine a rate of change associated with the film buffer.

At block 308, the system can determine the first rate associated with the drive roller pair. In some embodiments, and as noted above, the first drive roller pair can cause the dampening roller to traverse an associated axis by providing the film 102 to downstream systems at the first rate. Accordingly, the first rate can be identified and/or calculated based at least on the movement caused by the first drive roller pair.

At block 310, the system can determine the second rate based at least on the first rate and a position associated with the dampening roller. As discussed above, the system can determine the second rate based at least on the first rate and the position of the dampening roller such that the second drive roller pair extracts the film 102 from a film source 104 at a rate sufficient to fill the film buffer. In some embodiments, the second rate can be determined based on a minimum threshold or a minimum amount of the film 102 associated with the film buffer. The minimum threshold can indicate a stored amount of the film 102 that the film buffer is prevented from dropping below. Additionally, the minimum amount of the film 102 can be the stored amount of the film 102 where the dampening roll can no longer maintain the film tension and/or the first drive roller pair cannot extract additional film from the film buffer without damaging the film 102. Accordingly, the second rate can be determined to be equivalent to the first rate or surpassing the first rate.

At block 312, the second rate associated with the second drive roller pair can be updated to a new rate based at least on a third rate associated with the first drive roller pair and/or the position associated with the dampening roller. In some embodiments, the third rate can be associated with the first drive roller pair based at least on the system receiving an indication from the downstream systems that the film 102 should be provided at the third rate. Accordingly, based on the first drive roller pair operating at the third rate, the system can update the second rate to cause the second drive roller pair to operate at a fourth rate.

In some additional embodiments, blocks 308, 310, and 312 represent an iterative method for monitoring the film buffer, maintaining the film tension, and controlling the film 102. For instance, the first drive roller pair and the second drive roller pair can be respectively operating at an initial first rate and an initial second rate. As noted above, the initial first rate can be constrained by the indication received from the upstream system. Similarly, the initial second rate can be constrained by the film source 104. Additionally, the initial first rate and the initial second rate can be predetermined and/or operating at a steady state during block 302. Further, the initial first rate and the initial second rate can cause the film buffer to reach a maximum threshold, a maximum amount of stored film, the minimum threshold, or the minimum amount of stored film associated with the film buffer. Based at least on one of the above conditions and/or thresholds being met, the system can determine at least one of an updated first rate or an updated second rate.

In at least one embodiment, the method can determine the first updated rate based at least on the initial second rate being unmodifiable due to constraints associated with the film source and/or isolating the tensioning and steering systems from the film source 104. For instance, the film source 104 can comprise a maximum film extraction rate associated with the second initial rate that protects the film 102 and the film source 104 from damage.

In at least one additional embodiment, the method can determine the second updated rate based at least on the initial first rate being unmodifiable due to constraints associated with the downstream systems or the indications received from the downstream systems. For instance, the downstream system can comprise a maximum receiving rate associated with the first initial rate that prevents errors within the downstream system.

In at least one further embodiment, the determination of the first initial rate, the second initial rate, the first update rate, and/or the second update rate can be accomplished by a programmable logic controller (PLC). For example, the PLC can utilize PID controls and information regarding the various rates and system components to modulate and adjust the various rates associated with the first drive roller pair and the second drive roller pair. Additionally, the PLC can be programmed with logic capable of determining an appropriate film rate for the first drive roller pair based at least on the dampening roller and the second drive roller pair. Similarly, the PLC can be programmed to determine an appropriate film rate for the second drive roller pair based at least on the dampening roller and the first drive roller pair.

Accordingly, the method illustrated by FIG. 3 can repeatedly update the first rate and the second rate based at least on changing conditions within the dampening system, the film buffer, the film source 104 and/or downstream systems. Further, the method can modify the first rate and the second rate based at least on received indications associated with downstream systems and constraints associated with the film source 104.

Figure 4:
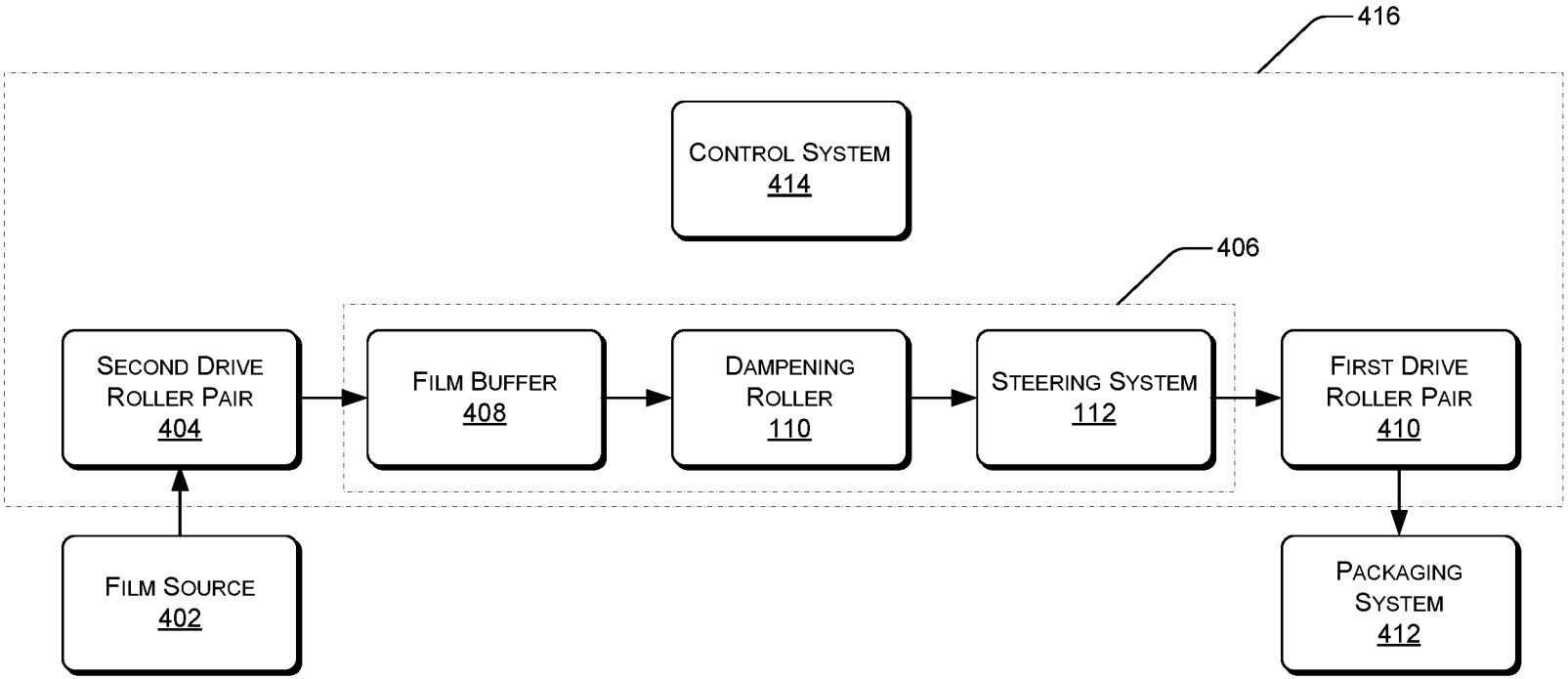
FIG. 4 illustrates a block diagram of the components within an isolated tensioning and steering system and a path followed by the film through the isolated system.

FIG. 4 illustrates a block diagram of the components associated with an isolated tensioning and steering system. The isolated tensioning and steering system can extract at least the film 102 from a film source 402. Additionally, the system can provide the at least film 102 to a packaging system 418. Further, the system can be isolated from the film source 402 and the packaging system 418 by a first drive roller pair 412 and a second drive roller pair 404. For instance, the isolated systems can comprise a film buffer 408, a dampening roller 110, and a steering system 112 controlled and monitored by a control system 410.

In some embodiments, a film source 402 can be the film source 104 and/or another film source described by the above embodiments. For instance, the film source 402 can comprise a loose film, a loosely wrapped film, and/or a loosely stored film. In at least one embodiment, the film can be a bubble film comprised of a plurality of air pockets and/or fluid filled pockets associated with a maximum compression threshold. The maximum compression threshold can indicate a level of pressure or force that, if exceeded, can damage the film source 402. In some additional embodiments, the film source 402 is the loosely wrapped film supported by a mandrel, axis, axel, or other support component. In at least one additional embodiment, the film source 402 is a cylinder of film loosely wrapped around the support component such that the film source 402 does not experience pressure or force exceeding the maximum compression threshold.

In some additional embodiments, the film source can rotate around the support component based at least on the film being extract from the film source 402 by the second drive roller pair 404. Additionally, braking cannot be applied to the support component associated with the film source 402 due to additional pressure applied to the film. The additional pressure can be caused by the film compressing around the support component as the outer layers continue to rotate while the central layers are slowed. In at least one further embodiment, braking is applied to the film source 402 at the outer layer and/or at the edges of the film source 402. Braking can be applied to the outer layer of the film source 402 by one or more support rollers and/or one or more adjustable surfaces associated with the film source 402. Braking can be applied to the film source 402 by one or more plates and/or rigid surfaces configured to apply friction to one or more film source edges.

In some further embodiments, the film source 402 can include a source sensor the can be configured to determine when the film source needs to be replaced. The source sensor can determine when a load associated with the support component falls below a load threshold. Additionally, the source sensor can determine a volume associated with the film source 402 and identify that the volume falls below a volume threshold. Further, the source sensor can determine the length of the film remaining within film source 402 and identify when the length of the film falls below a film threshold. The source sensor can transmit an alert or indication that causes the film source to be either manually or automatically replaced. In at least one embodiment, the source sensor can determine an applied weight associated with the mandrel that supports the film source 402 and identify when the applied weight is equal to or less than the weight of the mandrel or the load threshold. In at least one additional embodiment, the source sensor can determine the radius of the film source and identify when the mandrel no longer supports a volume of the film or when the volume of the film is equal to or less than the volume threshold. In at least one further embodiment, the source sensor can measure the length of the film that has been extracted from the film source and determine when the length is equal to or greater than the total amount of the film within the film source 402 or the film threshold.

In some embodiments, a second drive roller pair 404 is configured to isolate the film source from the isolated tensioning and steering systems 406 from the film source 404. Based at least on one or more film characteristics, including the maximum compression threshold, a film source tension can differ from the film tension associated with the tensioning and steering systems 406. Accordingly, and as discussed above, the second drive roller pair 404 can extract the film from the film source 402, secure the film, and provide the film to the isolated systems 406 at a second rate.

In some embodiments, the isolated systems include the film buffer 408, the dampening roller 110, and steering system 112. The film buffer 408 and the dampening roller 110 can store film provided by the second drive roller pair at the film tension associated with the isolated systems 406. Additionally, film buffer 408 and the dampening roller 110 can function as described above with respect to FIGS. 1, 2, and 3. The steering system 112, as discussed above as steering system 112, can comprise one or more steering system requirements that include at least an indication of a minimum film tension. Accordingly, film buffer 408 and dampening roller 110 can maintain the film tension above the minimum film tension by applying a force to the film.

In some additional embodiments, the steering system 112 can steer the film by either rotational or linear adjustments to the film path. The rotation adjustments can be performed by the steering system 112 rotating around a central axis and causing the film path to be adjusted to the right or left. Similarly, the linear adjustments can be performed by the steering system 112 moving right or left along an axis perpendicular to the film path. In at least one embodiment, the steering system comprises one or more guide rollers that cause the film path to be shifted by the steering system 112. In at least one additional embodiment, the steering system 112 is a commercially available steering system that has been mounted to a tensioning system. For example, the commercially available steering system can be a Maxcess® Fife LRB Offset Pivot Guide.

In some embodiments, the isolated systems 406 can provide the film to the first drive roller pair 412. Similar to the second drive roller pair 404, the first drive roller pair 418 isolates the isolated systems 406 from the packaging system 418. Similar to the film source 402, packaging system 418 can comprise a packaging tension different from the film tension maintained between the first drive roller pair 418 and the second drive roller pair 404.

In some embodiments, the first drive roller pair 412, the isolated systems 406, and the second drive roller pair 404 can be monitored systems 416. For instance, control system 410 can monitor and cause the monitored systems 416 to perform the actions described by FIG. 1 and the method steps described by FIGS. 2 and 3. The control system 410 can be configured to receive measurements from and transmit instructions to each of the monitored systems 416 during operation. Additionally, control system 410 can receive indications from film source 402 and packaging system 418. Based at least on the indications, the control system 410 can modify the operation of the monitored systems 416. Further, control system 410 can implement a variety of control schemes to maintain the amount of film stored by film buffer 408.

In some additional embodiments, the packaging system 418 can be an automated packaging system or a partially automated packaging system. The tensioning and steering system can be configured to supply aligned film to the automated packaging system based at least on an indication received from the automated packaging system or from an operator associated with either system. Additionally, the tensioning and steering system can be attached, removably attached, or associated with the automated packaging system while providing the aligned film. For instance, the automated packaging system can request a first amount of film to form a package, wherein the package is formed by folding the first amount of film and using sealing bars to at least form vertical seals along the edges of the film. Accordingly, for vertical seals to be formed the film must be properly aligned so that the sealing bars are able to adhere the film on a first portion of film to a second portion of film. The tensioning and steering system, via the steering system, can be configured to provide the requested film within an alignment tolerance. By providing the aligned film to the automated packaging system, package forming errors can be minimized while increasing system efficiency. In at least one embodiment, the automated packaging system configured to form a package from the provided film can be a PACjacket™ system associated with the isolated tensioning and steering system. In at least one additional embodiment, the automated packaging system can be configured to form horizontal film seals along the edges of the film. Similarly, for horizontal seals to be formed, the film must be properly aligned so that the sealing bars are able to adhere the film on a first portion of film to a second portion of film.

Figure 5:
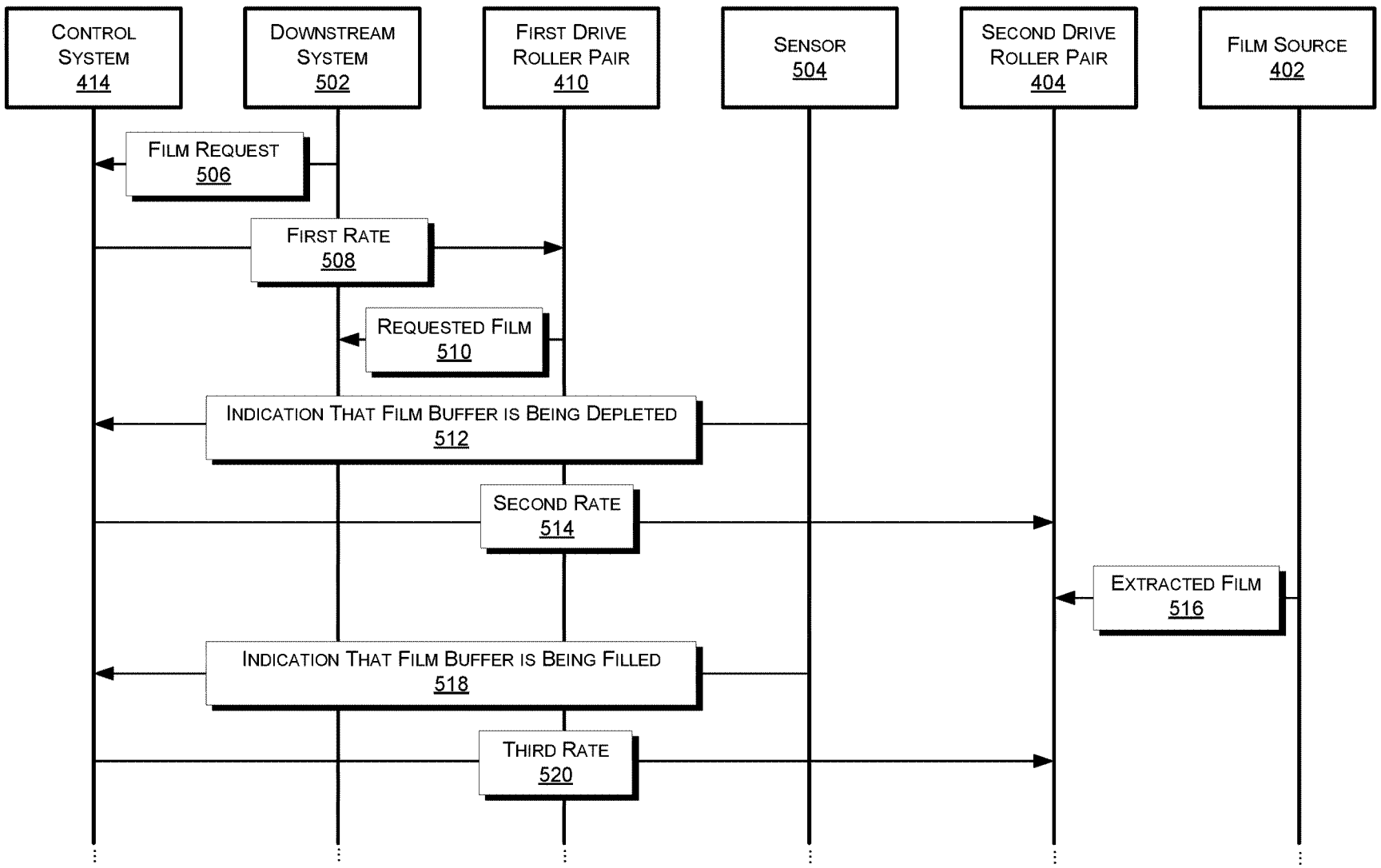
FIG. 5 illustrates a flow diagram that describes the exchange of information and commands by a control system used to maintain film tension in an isolated tensioning and steering system.

FIG. 5 illustrates a flow diagram that describes the exchange of information and commands by a control system. The control system 410 can comprise one or more processors and a memory containing one or more instructions that cause the control system 410 to execute the actions depicted by the flow diagram.

In some embodiments, downstream system 502 can transmit a film request 506 to the control system 410. The film request 506 can comprise an indication regarding one or more of a first amount of requested film 510, a timing schedule associated with the first amount of film, a rate associated with the provision of film, film alignment information, and/or additional requirements that cause the tensioning and steering system to provide film to the downstream system.

In some embodiments, the control system can transmit a first rate 508 to the first drive roller pair 412. The first rate 508 can be transmitted based at least on the film request 506 received from the downstream system 502. In at least one embodiment, the first rate 508 can be determined based at least on the film request 506. In at least one additional embodiment, the first rate 508 can be determined based at least on an indication of a stored amount of film within a film buffer that is measured by a sensor 504. Accordingly, the first drive roller pair 412 can provide the requested film 510 to the downstream system 502.

In some embodiments, and as noted above, the sensor 504 can monitor a film buffer comprising the stored amount of a film. Additionally, the sensor can determine that the film buffer is in the process of being depleted and automatically transmit an indication 512 to the control system 410. Further, the control system 410 can monitor the film buffer based at least on the sensor and determine that the film buffer is in the process of being depleted. In response to at least one of the indication 512 or a determination that the film buffer is being depleted, the control system 410 can determine a second rate 514. The second rate 514 can be determined as discussed above and transmitted to the second drive roller pair 404. Accordingly, the control system 410 can cause the second drive roller pair to extract film from the film source 402 and provide the extracted film 516 to the film buffer. In at least one embodiment, the control system can determine that the film buffer is being depleted based at least on the stored amount of the film in the film buffer being equal to or less than a threshold amount of film.

Similar to the indication that the film buffer is being depleted 512, the sensor can determine that the film buffer is being filled and transmit an indication 518 to the control system 410. Additionally, the control system 410 can monitor the film buffer based at least on the sensor and determine that the film buffer is in the process of being filled. In response to at least one of the indication 512 or a determination that the film buffer is being filled, the control system 410 can determine a third rate 520. The third rate 520 can be determined based at least on the first rate 508, the second rate 514, and the stored amount of film associated with the film buffer. Accordingly, the control system 410 can modify the second rate 514 to the third rate 520 and cause the second drive roller pair to extract film from the film source 402 at the third rate 520.

Figure 6:
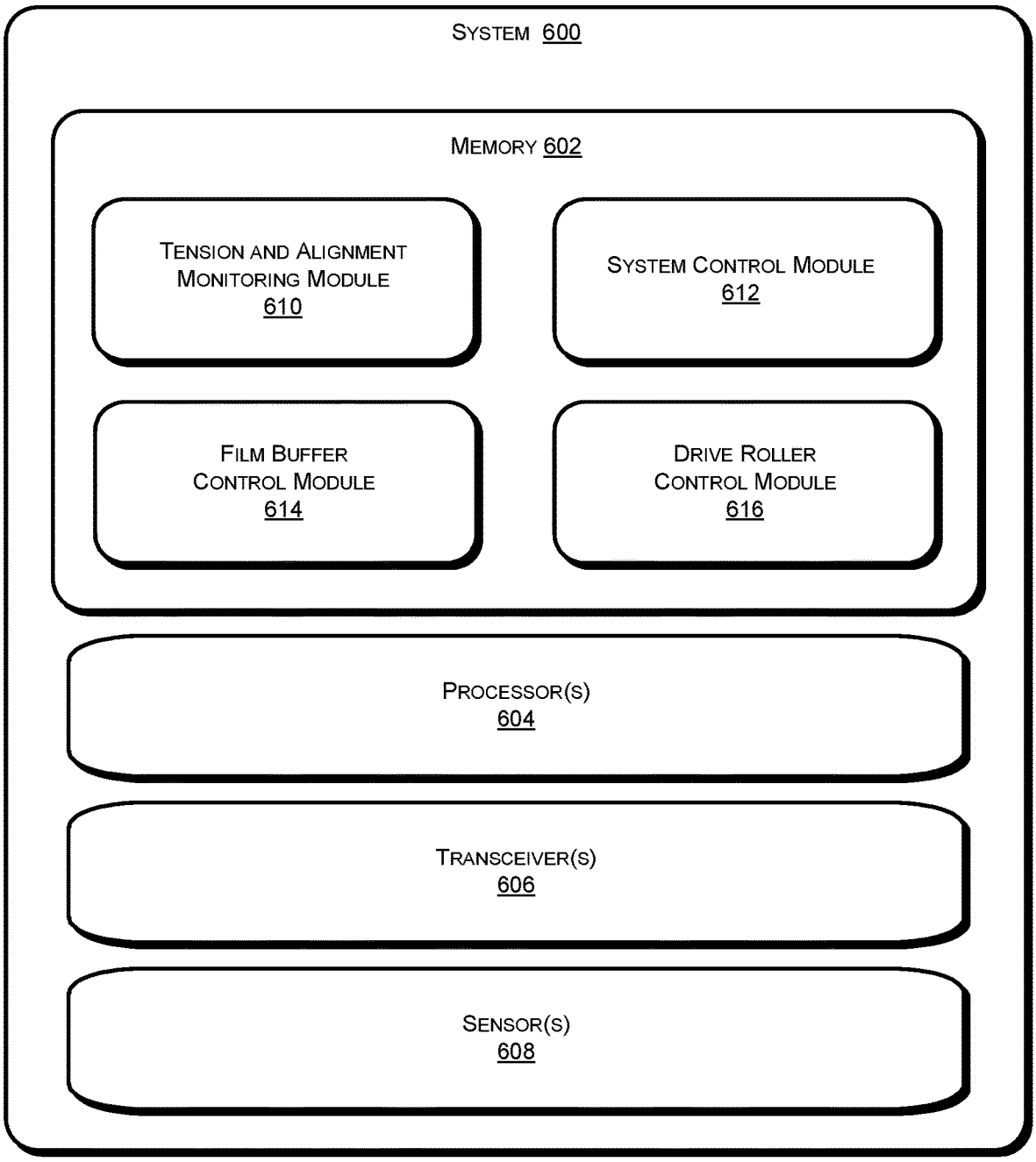
FIG. 6 illustrates a block diagram of a control system that operates the isolated tensioning and steering system and causes the isolated tensioning and steering system to maintain a film tension, extract the film from a film source, and provide the film to a downstream system.

FIG. 6 illustrates a block diagram of a control system that operates the tensioning and steering system as disclosed herein and in accordance with some examples of the present disclosure. In some embodiments, control system 600 can correspond to any of the control systems discussed in FIGS. 2-5. As illustrated, control system 600 is generally comprised of memory 602, one or more processors 604, one or more transceivers 606, and one or more sensors 608.

In some embodiments, memory 602 can be volatile (such as RAM), non-volatile (such as ROM, flash memory, etc.) or some combination of the two. The memory 602 may include removable storage, non-removable storage, and other forms of computer-readable media including, but not limited to RAM, ROM, EEPROM, flash memory, other memory technologies, CD-ROM, DVDs, content-addressable memory (CAM), other optical storage, magnet storage, and any other medium which can be used to store the desired information in a format that the control system 600 accesses during execution of the above methods and/or operation of the above systems. The memory 602 can comprise one or more modules that cause the processors to execute one or more instructions and perform the operations discussed above. Further, the memory 602 can comprise additional modules that can be executed by the processors 604 and cause the processors 604 to perform additional operations associated with the control system 600. The additional modules can comprise network forwarding modules, network monitoring modules, packaging system modules, and film source modules.

In some embodiments, the processors 604 can include one or more central processing units (CPUs), one or more graphics processing units (GPUs), both CPUs and GPUs, or other processing units or components known in the art.

In some embodiments, the transceivers 606 can include one or more wired or wireless transceivers. For instance, the transceivers 606 can include a network interface card, a network adapter, a LAN adapter, an address associated with a network connection, or another device permitting communications to be sent and received. Additionally, the transceivers 606 can comprise any wireless transceiver capable of engaging in wireless, radio frequency (RF) communication. Further, the transceivers 606 can also include other wireless modems, such as Wi-Fi, WiMax, Bluetooth, and/or infrared communication modems.

In some embodiments, one or more sensors of the sensors 608 can be associated with each of components of the tensioning and steering systems described above with respect to FIG. 1-5. For instance, the first drive roller pair and the second drive roller pair can be associated with a rate sensor, a pressure sensor, and/or other sensors capable of collecting data related to the tensioning and steering system. Additionally, the dampening system and the dampening roller can be associated with one or more dampening sensors of the sensors 608. The dampening sensors can collect data relating to the film tension, operation and movement of the dampening roller, and operation of the dampening system. Additionally, the sensors 608 can collect data relating to the film buffer and the status of film within the film buffer.

In some additional embodiments, the sensors 608 can be associated with the film source. The sensors 608 can be associated with the film source and collect data relation to the amount of film within the film source, the weight of the film source, the film tension associated with the film source, the speed of the film source, and/or other data relating to the operation of the film source.

In some embodiments, the memory 602 includes a tension and alignment monitoring module 610. The tension and alignment monitoring module 610 can cause the processors 604 to monitor the tensioning and steering systems. For instance, the tension and alignment monitoring module can cause the processors 604 to monitor at least the dampening roller described by the above methods and systems. Additionally, the tension and alignment monitoring module 610 can monitor the first drive roller pair, the second drive roller pair, the steering system, and/or the dampening system. Further, the tension and alignment monitoring module, via the processors 604 and the sensors 608, can collect data relating to the current state of the above components of the tensioning and steering systems to be used by the system control module 612 and the film buffer control module 614. Additionally, the tension and alignment monitoring module 610 can send and receive data via the transceivers 606.

In some embodiments, memory 602 includes system control module 612. The system control module 612 can cause the processors 604 to transmit a signal to components of the tensioning and steering system and/or systems connected to the tensioning and steering system. For instance, the system control module 612 can transmit a signal to audible alert, visual alert, or some other alert that indicates that the tensioning and steering system requires outside intervention. Additionally, the system control module 612 can cause the processors 604 to transmit signals to and receive signals from systems associated with the isolated tensioning and steering system such as downstream systems and packaging systems. Further, the system control module 612 can receive indications from operators of the isolated tensioning and steering system.

In some embodiments, memory 602 includes a film buffer control module 614. The film buffer control module 614 can cause the processors 604 to determine values and operations for the various components of the tensioning and steering system. For instance, the film buffer control module 614 can measure, calculate, receive, obtain, or otherwise determine the film tension associated with the steering system, the film tension associated with the dampening system, and other tensioning and steering system variables. Additionally, the system control module can determine the system variables based upon data collected by the sensors 608. Further, the system control module can determine the system variables based upon indications received by the transceivers 606. Based on the system variables, the film buffer control module 614 can cause the film buffer, the dampening system, and/or the dampening roller to modify the film tension.

In some embodiments, memory 602 includes a drive roller control module 616. The drive roller control module 616 can cause the processors 604 to determine values and operations for the various components of the tensioning and steering system. For instance, the drive roller control module 616 can determine the first rate associated with the first drive roller pair, determine the second rate associated with the second driver roller pair, and modify the first rate and the second rate based on the system variables determined by the film buffer control module 614.

Figure 7:
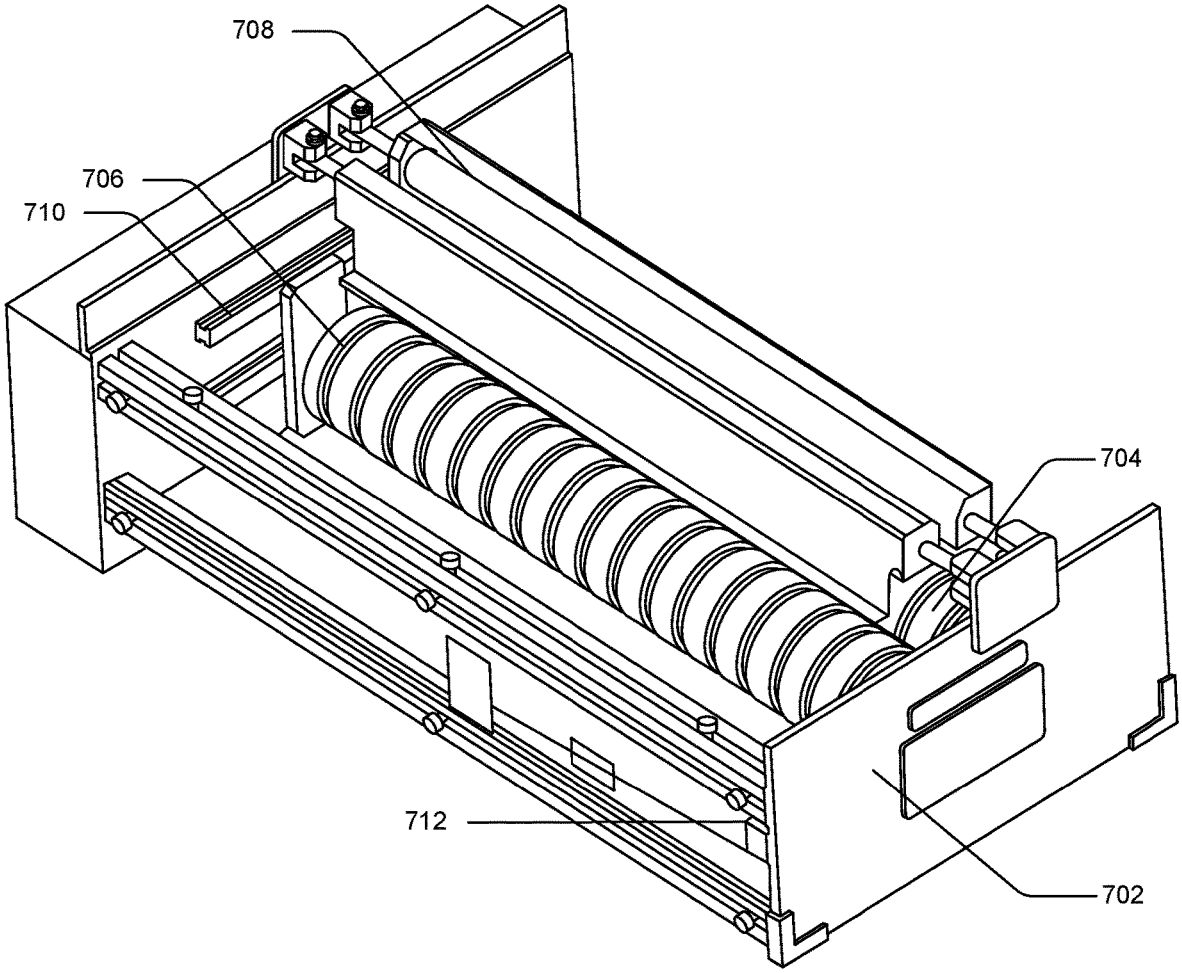
FIG. 7 illustrates an example configuration of a drive roller pair as a nip roller pair for securing the film for an isolated tensioning and steering system.

FIG. 7 illustrates an example configuration of a drive roller pair as a nip roller pair for securing the film for an isolated tensioning and steering system. The first drive roller pair 410 and the second drive roller pair 404 can be configured as the nip roller pair as illustrated by FIG. 7. In some embodiments of FIG. 7, the nip roller pair is attached to the system as a nip roller system 702. In particular, the nip roller system 702 operates to support and maintain a first nip roller 704 and a second nip roller 706 at a predetermined distance. As noted above, the predetermined distance can be determined based on one or more film characteristics and one or more roller characteristics. As similarly noted above, the first nip roller 704 and the second nip roller 706 can be configured so that the film being extracted from the film source is secured such that the isolated tensioning and steering system is isolated from the film source 104 without damaging the film that passes through the predetermined distance.

In some embodiments of FIG. 7, the nip roller system 702 has one or more film guides 708 associated with the first nip roller 704 and the second nip roller 706. In at least one embodiment, the film guides 708 are mounted between the nip roller system 702 and the film source 104 such that the film edges are not folded over the film itself. Additionally, the film guides 708 can be permanently or removably mounted to the nip roller system 702. Further, the film guides 708 can be located in a fixed position or in an adjustable position that can be adjusted to accommodate a plurality of different films.

In some embodiments of FIG. 7, the first nip roller 704 and the second nip roller 706 can be mounted in a fixed location on the nip roller system 702. Alternatively, the first nip roller 704 and the second nip roller 706 can be mounted to the nip roller system 702 via a nip roller rail 710. In at least one embodiment, the first nip roller 704 can be mounted to the same nip roller rail 710 as the second nip roller 706. In at least one additional embodiment, the first nip roller 704 and the second nip roller 706 can each be associated with individual nip roller rails 710. Further, the nip roller rail 710 can be configured such that the first nip roller 704 and the second nip roller 706 are mounted with no offset from one another in relation to the film. In at least one further embodiment, the first nip roller 704 and the second nip roller 706 can be mounted with an offset such that the film first contacts the first nip roller 704.

In some embodiments of FIG. 7, a nip roller sensor 712 can be mounted to the nip roller system 702 to detect the status of the film as it enters and/or exits the predetermined space between the first nip roller 704 and the second nip roller 706. Accordingly, the nip roller sensor 712 can detect whether the film is damaged while traversing the predetermined space. Should the film be damaged, an alert can be transmitted to the control system 414 that indicates the first nip roller 704 and the second nip roller 706 need to be adjusted.

Figure 8:
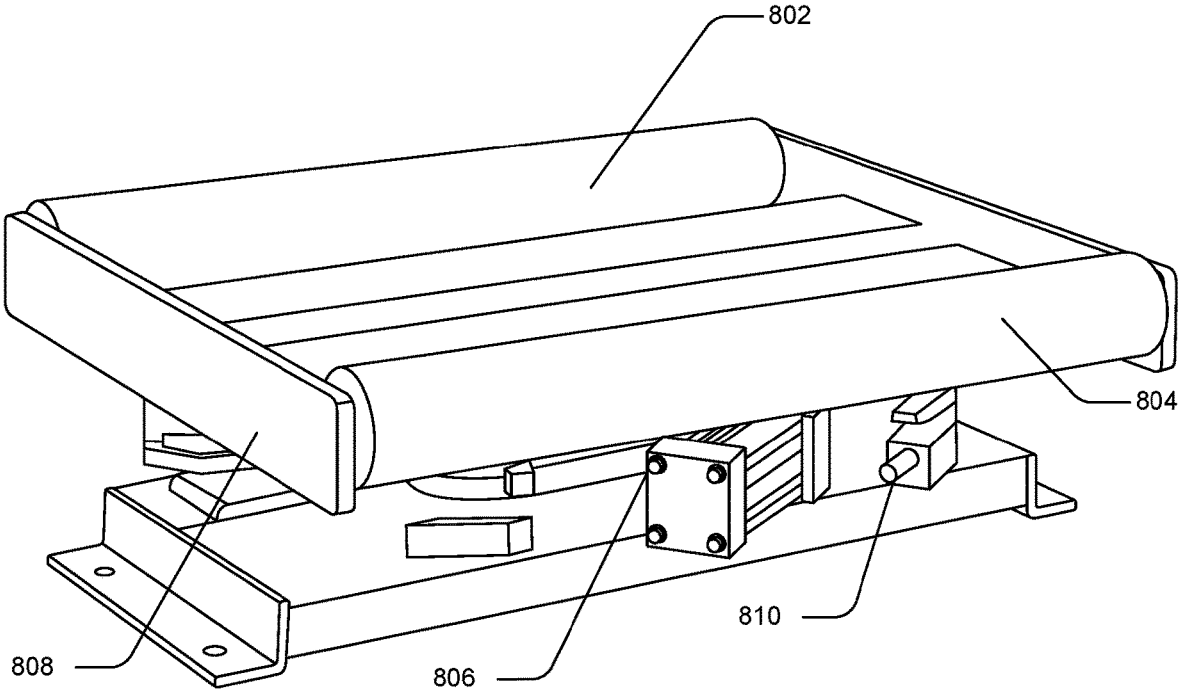
FIG. 8 illustrates an example steering system for aligning the film prior to providing the film to a downstream system.

FIG. 8 illustrates an example steering system for aligning the film prior to providing the film to a downstream system. In some embodiments of FIG. 8, the steering system 112 can comprise a first steering roller 802 and a second steering roller 804. Similar to the first drive roller 106, the second drive roller 108, the third drive roller 114, and the fourth drive roller 116, the first steering roller 802 and the second steering roller 804 can include one or more roller characteristics. For instance, the first steering roller 802 and the second steering roller 804 can comprise a roller surface material and a roller surface pattern. As discussed above with respect to the drive rollers, the one or more roller characteristics can be used to determine a minimum steering film tension that is required by the steering system 112. In at least one embodiment, the steering system 112 requires the minimum steering film tension be maintained or exceeded by the film tension of the isolated tensioning and steering system in order to align the film.

In some additional embodiments, a film can wrap over the top of the first steering roller 802, cross the space between the first steering roller 802 and the second steering roller 804, and wrap under the second steering roller 804 before proceeding to the first drive roller pair 410. By directing the film over the first steering roller 802 and under the second steering roller 804, the steering rollers can be used as anchor points by the steering system 112 when aligning the film. In particular, the minimum steering film tension, the first steering roller 802 and the second steering roller 804 can apply a directional force to the film as it traverses the steering system 112 and cause the path of the film to be adjusted to the left or right by the time that the film reaches the first drive roller pair 410.

In some embodiments, a steering drive 806 can apply the directional force to the first steering roller 802 and the second steering roller 804 via the steering frame 808. For instance, the steering drive 806 can include a motor configured to rotate the steering frame in a clockwise or counterclockwise direction. In at least one embodiment, where the film leaves the second steering roller 804 to be provided to a downstream system, the steering drive 806 can rotate the system clockwise to adjust the alignment of the film to the left and can rotate the system counterclockwise to adjust the alignment of the film to the right.

In some additional embodiments, the steering drive 806 can apply the directional force to the steering frame 808 to adjust the path of the film via linear motions. For instance, the steering drive can include an actuator configured to shift the steering frame 808 perpendicular to the path of the film. Accordingly, by driving the steering frame 808 to the left, the steering system 112 can adjust the alignment of the film to the left and by driving 808 to the right, the steering system 112 can adjust the alignment of the film to the right.

In some embodiments, the steering system can receive an indication from one or more alignment sensors associated with the isolated tensioning and steering system. For instance, the one or more alignment sensors can be associated with the first drive roller pair and determine whether the film is properly aligned. In response to determining that the path of the film has wandered, the one or more alignment sensors can transmit an indication to the steering system 112 that causes the steering drive 806 to make the appropriate adjustment. In some additional embodiments and as shown by FIG. 8, the one or more steering sensors 810 can be mounted to the steering system 112 and determine the film path as the film leaves the steering system 112. In at least one embodiment, the alignment of the path of the film can be determined based at least on the one or more steering sensors 810 and/or the one or more alignment sensors associated with the isolated tensioning and steering system.

Figure 9:
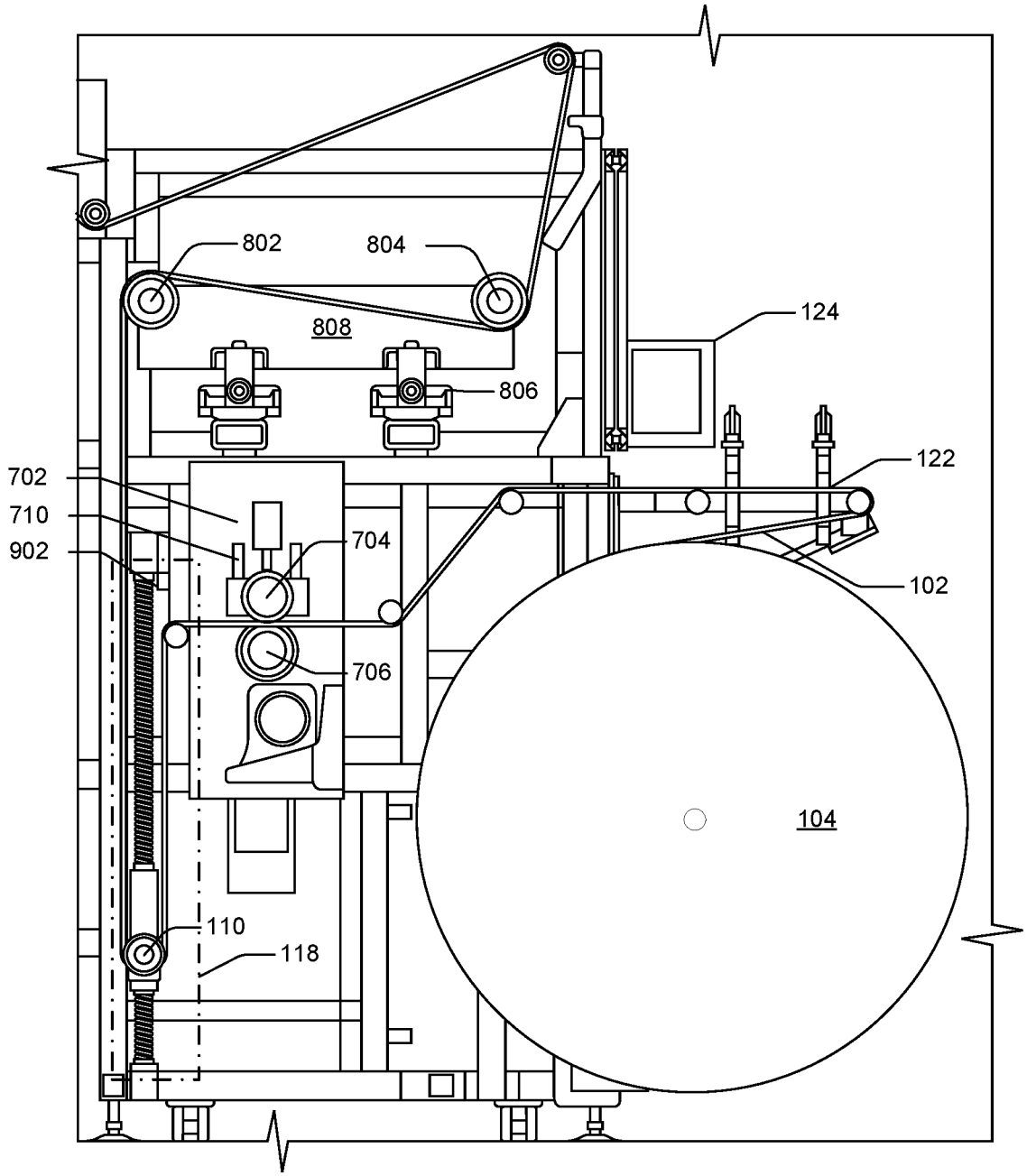
FIG. 9 illustrates a detailed system for extracting film from a film source, aligning the extracted film for a downstream system, and providing the film to the downstream system while maintaining a film tension in an isolated tensioning and steering system.

FIG. 9 illustrates a detailed system for extracting film from a film source, aligning the extracted film for a downstream system, and providing the film to the downstream system while maintaining a film tension in an isolated tensioning and steering system. In particular, FIG. 9 illustrates a detailed portion of the isolated tensioning and steering system described by FIG. 1 that includes the nip roller pair described by FIG. 7 and the steering system 112 described by FIG. 8.

In some embodiments, the isolated tensioning and steering system can include a sensor 902. As noted above, the sensor 902 can monitor the status of the dampening roller 110 to determine its position and whether it has moved from a first position to a second position. Additionally, the sensor 902 can determine the rate at which the dampening roller 110 is moving. In some additional embodiments, the sensor 902 can monitor the dampening system 118. In some further embodiments, the sensor 902 can monitor a film buffer by monitoring the dampening roller 110 and/or the dampening system 118. The sensor 902 can determine at least an amount of the film 102 stored by the film buffer and a rate of change associated with the amount of the film 102 stored by the film buffer.

Although the subject matter has been described in language specific to structural features and/or methodological acts, it is to be understood that the subject matter defined in the appended claims is not necessarily limited to the specific features or acts described. Rather, the specific features and acts are disclosed as exemplary forms of implementing the claims.

What is claimed is:

1. A system comprising:

one or more processors; and a memory storing one or more instructions that are executable by the one or more processors to perform operations comprising:

monitoring a film buffer comprising a stored amount of a film and a dampening roller;

receiving an indication of a requested amount of the film;

causing, based at least on the indication, the requested amount of the film to be extracted from the film buffer at a first rate via a first drive roller pair;

determining, based at least on the dampening roller, that a current amount of film contained on the film buffer is equal to or less than a threshold amount;

determining, based at least on the current amount of film and the dampening roller, a second rate; and causing a second drive roller pair to provide the requested amount of the film from a film source at the second rate.

2. The system as recited in claim 1, further comprising a dampening system that includes one or more of:

a sensor;

a pneumatic system;

a hydraulic system;

a compression spring system;

a motor; and an actuator.

3. The system as recited in claim 1, wherein the operations further comprise:

detecting, via a dampening sensor, that the dampening roller has been moved from a first position to a second position that is different from the first position, wherein determining that the current amount of film is equal to or less than the threshold amount is based at least on the first position and the second position.

4. The system as recited in claim 1, wherein the operations further comprise:

determining, based at least on a film steering system and a film compression threshold, a first film tension;

maintaining, via the dampening roller, the first film tension;

determining that a compression level associated with the film meets or exceeds the film compression threshold; and maintaining, based at least on a determination that the compression level meets or exceeds the film compression threshold, a second film tension less than the first film tension.

5. The system as recited in claim 4, wherein:

the dampening roller is further configured to maintain the first film tension by applying a first force to the film, the first force determined based at least on the film compression threshold and one or more characteristics of the film steering system; and the film source comprises a braking system and is configured to maintain the second film tension by applying a second force to the film via the braking system.

6. The system as recited in claim 1, wherein monitoring the film buffer further comprises:

detecting, via a dampening sensor, a first position associated with the dampening roller;

detecting, via the dampening sensor, a second position associated with the dampening roller; and determining, based at least on the first position and the second position, the stored amount of the film and a rate of change associated with the stored amount of the film.

7. The system as recited in claim 1, wherein the film buffer further comprises at least one of:

one or more additional dampening rollers, the one or more additional dampening rollers configured to traverse an associated axis; or one or more storage rollers located at a fixed position.

8. The system as recited in claim 1, wherein the film source comprises:

a mandrel that is configured to support the film source and allow the film to be extracted from the film source; and a braking system comprising at least one of:

one or more rotational brakes that apply first friction to an exterior surface of the film source; or one or more compression brakes that apply second friction to one or more sides of the film source.

9. The system as recited in claim 1, wherein the film source comprises a splicing table configured to connect the film source to a second film source and wherein the operations further comprise:

determining that the film source is to be replaced;

suspending operation of the second drive roller pair;

replacing the film source with the second film source;

connecting a film trailing edge associated with the film source to a film leading edge associated with the second film source; and resuming operation of the second drive roller pair.

10. A method comprising:

receiving an indication of a requested amount of film;

causing, based at least on the indication, the requested amount of the film to be extracted from a film buffer at a first rate via a first drive roller pair;

determining, based at least on a dampening roller associated with the film buffer, that a current amount of film contained on the film buffer is equal to or less than a threshold amount;

determining, based at least on the current amount of film and the dampening roller, a second rate; and causing a second drive roller pair to provide the requested amount of the film from a film source at the second rate.

11. The method as recited in claim 10, further comprising:

receiving an additional indication of an additional requested amount of the film;

determining, based at least on the dampening roller, that the current amount of film contained on the film buffer is greater than the threshold amount; and causing the additional requested amount of the film to be provided from the current amount of film on the film buffer.

12. The method as recited in claim 10, further comprising:

detecting, via a dampening sensor, that the dampening roller has been moved from a first position to a second position that is different from the first position, wherein determining that the current amount of film is equal to or less than the threshold amount is based at least on the first position and the second position.

13. The method as recited in claim 10, further comprising:

determining, based at least on a film steering system and a film compression threshold, a first film tension;

maintaining, via the dampening roller, the first film tension;

determining that a compression level associated with the film meets or exceeds the film compression threshold; and maintaining, based at least on a determination that the compression level meets or exceeds the compression threshold, a second film tension less than the first film tension.

14. The method as recited in claim 13, wherein maintaining the second film tension further comprises:

determining, based at least on the film compression threshold and the second film tension, a braking force that is applied to maintain the second film tension; and causing a braking system of the film source to apply the braking force to the film provided to the film buffer.

15. The method as recited in claim 10, wherein causing the second drive roller pair to provide the requested amount of the film from the film source at the second rate further comprises causing the requested amount of the film to be provided from the current amount of film at a first time and the requested amount of the film to be provided to the film buffer at a second time.

16. A non-transitory computer-readable storage medium having computer executable instructions stored thereupon which, when executed by one or more processors, cause the one or more processors to perform operations comprising:

monitoring a film buffer comprising a stored amount of a film and a dampening roller;

receiving an indication of a requested amount of the film;

causing, based at least on the indication, the requested amount of the film to be extracted from the film buffer at a first rate via a first drive roller pair at a first time;

determining that a current amount of film contained on the film buffer is equal to or less than a threshold amount;

determining, based at least on the current amount of film and the first rate, a second rate for filling the film buffer from a film source; and causing a second drive roller pair to provide at least the requested amount of the film from the film source at the second rate at a second time.

17. The non-transitory computer-readable storage medium of claim 16, wherein the operations further comprise:

determining that the film source is to be replaced;

suspending operation of the second drive roller pair;

replacing the film source with a second film source;

connecting a film trailing edge associated with the film source to a film leading edge associated with the second film source; and resuming operation of the second drive roller pair.

18. The non-transitory computer-readable storage medium of claim 16, wherein causing, based at least on the indication, the requested amount of the film to be extracted from the film buffer at the first rate via the first drive roller pair further comprises causing the requested amount of the film to be extracted from the film buffer under a film tension, the film tension maintained by the first drive roller pair and the second drive roller pair.

19. The non-transitory computer-readable storage medium of claim 18, the operations further comprising:

determining that the film tension is less than a steering tension threshold associated with a film steering system; and causing the dampening roller to maintain a second film tension greater than or equal to the steering tension threshold.

20. The non-transitory computer-readable storage medium of claim 16, wherein monitoring the film buffer further comprises:

detecting, via a dampening sensor, a first position associated with the dampening roller;

detecting, via the dampening sensor, a second position associated with the dampening roller; and determining, based at least on the first position and the second position, the stored amount of the film and a rate of change associated with the stored amount of the film.

* * * * *